313-422 SR
5/8/79 OR 4,153,856

United States Patent [19]
Siekanowicz et al.

[11] 4,153,856
[45] May 8, 1979

[54] PROXIMITY FOCUSED ELEMENT SCALE IMAGE DISPLAY DEVICE

[75] Inventors: Wieslaw W. Siekanowicz, Lawrenceville; Thomas L. Credelle, East Windsor, both of N.J.

[73] Assignee: RCA Corporation, New York, N.Y.

[21] Appl. No.: 797,405

[22] Filed: May 16, 1977

[51] Int. Cl.[2] ..... H01J 29/56; H01J 29/80; H01J 31/20

[52] U.S. Cl. ..... 313/422

[58] Field of Search ..... 313/400, 422

[56] References Cited

U.S. PATENT DOCUMENTS

| | | | |
|---|---|---|---|
| 671,358 | 3/1976 | Siekanowicz et al. | 313/422 |
| 3,935,500 | 1/1976 | Oess et al. | 313/422 X |
| 4,028,582 | 6/1977 | Anderson et al. | 313/422 |
| 4,088,920 | 5/1978 | Siekanowicz et al. | 313/422 |

*Primary Examiner*—Robert Segal
*Attorney, Agent, or Firm*—Eugene M. Whitacre; Glenn H. Bruestle; George E. Haas

[57] ABSTRACT

An envelope of a display device includes a rear wall and a front wall having a cathodoluminescent screen thereon. Within the envelope are a plurality of electron beam guides and means for extracting electron beams out of the guide at various points. The electron beam guide comprises a first guide grid parallel to and spaced from the rear wall and a guide grid structure between the first grid and the front wall. Although there are unequal electric fields on the front and rear sides of the beam guide, the first guide grid and the guide grid structure maintain symmetry of the electric fields within the guide.

8 Claims, 3 Drawing Figures

PROXIMITY FOCUSED ELEMENT SCALE IMAGE DISPLAY DEVICE

BACKGROUND OF THE INVENTION

The present invention relates to image display devices and more particularly to such devices having a unique electron beam guide allowing proximity focusing of the electron beam.

Recently, several different types of large area image display devices have been suggested utilizing an envelope between 2.5 and 7.6 cm thick with a screen size of approximately 76×102 cm. One type of these display devices has a plurality of electron beam guides within the envelope to guide electron beams to various positions on a cathodoluminescent screen as disclosed in copending U.S. patent application Ser. No. 671,358 entitled "Flat Panel Display with Beam Guide" filed on Mar. 29, 1976 by W. W. Siekanowicz et al. These devices are applicable to "element scale displays" where a separate beam guide is employed to direct a beam to each picture element along one horizontal line.

The beam guides comprise electrodes similar to those in FIGS. 12–14 of the above Siekanowicz et al. application which establish symmetrical electric fields to confine and guide the beam in a path along the guide. The guides must be properly positioned within the device so that the high voltage on the screen does not unbalance the symmetrical fields in the guides. Therefore, the screen must be spaced a relatively large distance (e.g. 25 mm) from the guide so that the field strength (volts/mm) on the screen side of the guide is the same as the field strength on the opposite side of the guide. This relatively large distance causes excessive spreading of the beam which reduces image resolution and may adversely affect color purity. To prevent excessive angular beam spreading at the screen, focusing electrodes may be incorporated between the guide and the screen. These additional electrodes complicate manufacturing processes and require additional power supply bias voltages.

DETAILED DESCRIPTION OF THE PREFERRED EMBODIMENT

Figure 1:
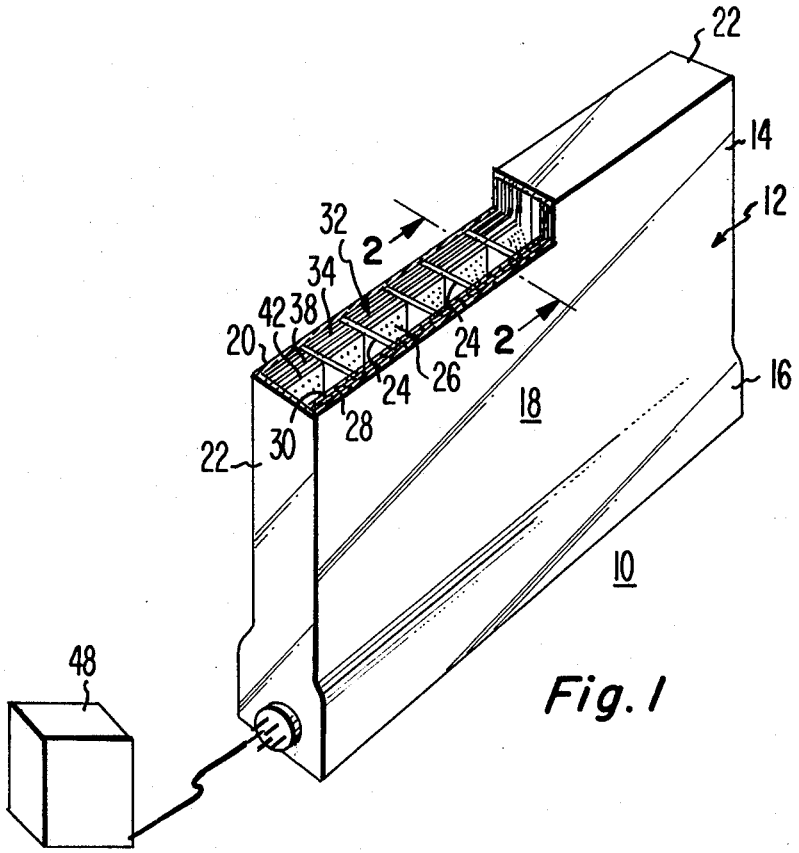
FIG. 1 is a cut-away perspective view of a flat panel display device incorporating the present invention.

With initial reference to FIG. 1, a flat panel image display device, generally designated as 10, includes an envelope 12 divided into a display section 14 and an electron gun section 16. The envelope further comprises a front wall 18 and a rear wall 20 in a parallel relationship spaced apart approximately 6.1 mm by sidewalls 22. Within the envelope 12 are a plurality of support walls 24 extending between the front and rear walls 18 and 20, respectively. The support walls 24 divide the envelope interior into a plurality of channels 26 and provide the internal support for the envelope against atmospheric pressure. On the interior surface of the front wall 18 is a cathodoluminescent screen 28 having a conductive coating 30 forming an anode.

Figure 2:
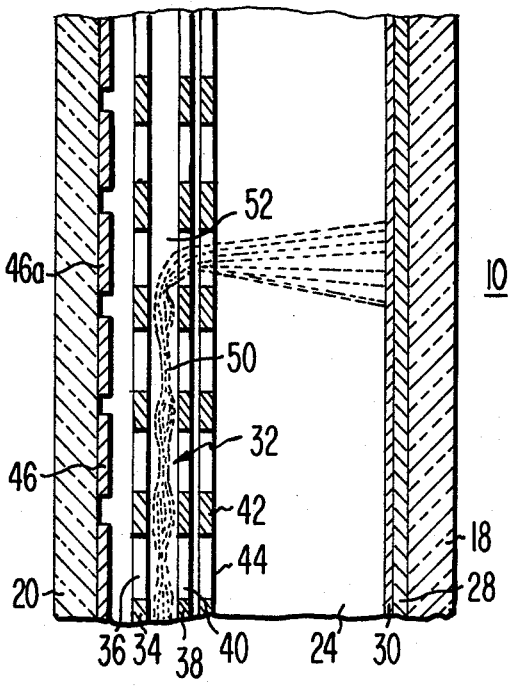
FIG. 2 is a sectional view taken along line 2—2 of FIG. 1.

Located within each channel 26 adjacent to the rear wall 20 are a plurality of electron beam guides 32. Beam guides 32 in each channel are formed by three substantially parallel guide grids 34, 38 and 42 extending transversely across each channel 26 parallel to the back wall 20 for the full length of the channel. As shown in FIG. 2, the first guide grid 34 is spaced from the rear wall 20 and has a plurality of apertures 36 extending therethrough and arranged in columns extending longitudinally along the channel and rows extending transversely across the channel. Each column of apertures 36 defines a separate electron beam guide 32. The distance between the back wall 20 and the first grid 34 may typically be 0.38 mm. The second guide grid 38 is between the first grid 34 and the front wall 18 spaced about 0.33 mm from the first grid. A plurality of apertures 40 arranged in columns extend through the second grid 38 aligned with the apertures 36 in the first guide grid 34. Between the second guide grid 38 and the front wall 18 is the third guide grid 42 spaced approximately 0.23 mm from the second guide grid. A plurality of apertures 44 arranged in columns extend through the third guide grid 42 aligned with the apertures in both of the other guide grids 34 and 38. Each of the guide grids 34, 38 and 42 may be formed of relatively thin metal sheets about 25 microns thick. The apertures in the grids may be about 0.32 mm high by 1.34 mm across. The apertures may be spaced 0.23 mm from each other both longitudinally and transversely in the channel 26. In alternate versions, the apertures 44 in the third grid 42 may be larger (e.g. 0.39 mm×1.34 mm) than the apertures in the other grids 34 and 38. In addition, the apertures 40 in the second grid 38 may be offset slightly from the apertures 36 in the first grid 34 (e.g. offset 0.1 mm farther from the gun section 16 along the direction of beam travel). The third grid apertures 44 in the offset version may be aligned with the second grid apertures 40 or slightly offset the same distance in the same direction.

A plurality of extraction electrode stripes 46 are on the rear wall 20 aligned with the apertures in the first guide grid 34 and extending transversely across the channel 26. A power supply 48, shown in FIG. 1, maintains the various electrodes within the display 10 at the proper electrical potential to guide the electron beam and display it on the screen. All three guide grids 34, 38 and 42 are electrically connected and maintained at the same potential. With respect to a display as dimensioned above, the voltage on the extraction stripes 46 is normally held at 167 volts and switched to −417 volts to extract electron beams as will be described later. All three guide grids 34, 38 and 42 are maintained at 22 volts while the screen electrode 30 is at about 7700 volts.

During the operation of the display device, a plurality of electron guns in the gun section 16 generate a number of electron beams which are directed into each of the guides between the first and second guide grids 34 and 38, respectively. The potential difference between the first grid plates 34 and the extraction stripes 46 and the potential difference between the second and third grid plates 38 and 42 and the screen electrode 30 create electrostatic force fields on each side of the guide 32. Because of the relatively short distance from the guide 32 to the high voltage screen electrode 30, the field on the screen side of the guide will be stronger than the field on the rear wall side. The guide grids balance the two fields to produce symmetrical fields within the guide between the first and second grids 34 and 38. The close proximity and equipotential of second and third grids 38 and 42 attenuate the electrostatic field from the screen side of the guide as the field penetrates the openings in the two grids. At the midpoint between the first and second grids 34 and 38 in FIG. 2, there is front to rear symmetry of the electrical fields between these grids. The symmetrical fields within the guide 32 confine the electrons into a beam 50 along the entire length of the guide. The beam 50 travels up the guide as shown in FIG. 2 until it reaches a point 52 where it is to be deflected toward the screen 28. The extraction electrode 46*a* at this point 52 is switched to a negative potential so as to alter the force field to repel the electron beam 50. The repelling of the electron beam deflects it out of the guide 32 through openings 40 and 44 in both the second and third guide grids 38 and 42. As the beam 50 travels between the beam guide 32 and the screen 28, it will begin to diverge since there has been no appreciable focusing fields applied to the electron beam. However, because the guide to screen distance has been decreased over previous devices from about 25 mm to 6.1 mm, the beam will not diverge so as to adversely affect the resolution of the display. The proper spot size of the beam at the screen is produced without the use of additional focus grid guides by reducing the guide to screen distance and maintaining a relatively high screen potential.

The novel beam guide structure permits proximity focusing since the guide to screen distance may be regulated to achieve the proper spot size without destroying the symmetry of the electrostatic fields within the guide. In devices, without this novel guide 32, if the screen 28 was moved closer to the guide 32 so as to proximity focus the beam 50, the field strength on the screen side of the guide would be greater than the field strength on the opposite side of the guide. The electron beam in this modified guide would be pulled out of the guide by the stronger field. The present invention permits the screen voltage to remain constant to achieve a high screen brightness while allowing the guide to screen spacing to be reduced. Even through the field strength on the screen side of the guide is greatly increased, the combination of the second and third grids 38 and 42 prevents the stronger field from penetrating into the guide so as to destroy the field balance therein. The field from the high anode voltage penetrates the guide only to balance the field from the voltage on the extraction stripes 46.

Additional reduction in the guide to screen spacing can be achieved by offsetting slightly along the direction of beam travel the second grid apertures 40 relative to the first grid apertures 36 while maintaining the alignment between the second grid apertures 40 and the third grid apertures 44. An even greater reduction in guide to screen spacing can be achieved by offsetting slightly the second grid apertures 40 relative to the first grid apertures 36 as described above and also offsetting the third grid apertures 44 relative to the second grid apertures 40 by the same distance and in the same direction as the second grid apertures 40 are offset relative to the first grid apertures 36. The offsetting of grid apertures described above effectively reduces the apertures opening to the screen electrostatic field thereby reducing field penetration from the screen side of the grid thus disturbing the symmetrical fields within the guide 32. To restore front to back field symmetry within the guide 32 while maintaining the same screen potential, the guide to screen spacing must be reduced with a resulting reduction in the thickness of the device.

Figure 3:
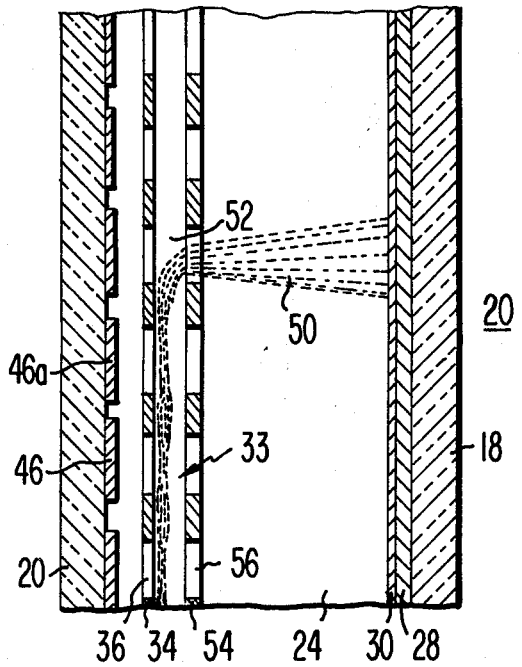
FIG. 3 is a section view similar to FIG. 2 but of another embodiment of the present invention.

With reference to FIG. 3, another embodiment 20 of the proximity focusing device substitutes a new electron guide 33 for the electron beam guide 32 of the embodiment in FIG. 2. The second guide structure 33 comprises only two guide grids 34 and 54. The first guide grid 34 is substantially identical to the first guide grid 34 in the embodiment of FIG. 2. The second guide grid 54 is positioned between the first guide grid 34 and the screen 28 and extends transversely across the channel 26 for the full length of the channel. The second guide grid 54 is substantially thicker than the first grid 34 and has a plurality of apertures 56 aligned with the apertures 36 and the first grid. For example, if all of the common dimensions and electrical potentials remain the same as in the embodiment of FIG. 2, the second focusing grid 54 in FIG. 3 is spaced 0.33 mm from the first grid 34 and has a thickness between about 0.15 mm and 0.25 mm. The spacing between the guide and the screen in this embodiment is about 6.8 mm. Alternately, the apertures 56 in the second grid 54 may be offset (e.g., 0.1 mm) from the first grid apertures 36 in the direction away from the gun section 16 thus permitting a further reduction in the guide to screen spacing for the reasons discussed above.

The display device 20 functions in substantially the same way as the device 10 in FIG. 2. By making the second guide grid 54 thicker, the high electrostatic field due to the screen voltage is prevented from penetrating into the guide so as to adversely affect the electrostatic field symmetry within the guide 32. This symmetry is maintained even though the screen 28 is positioned closer to the guide than in previous devices.

We claim:

1. In a flat panel image display device having an envelope with spaced front and rear walls, a cathodoluminescent screen on the front wall, an electron beam guide within the envelope and means for extracting the electron beam at various points along the guide, the improvement wherein the guide comprises:

a first guide grid within the envelope spaced from and parallel to the rear wall for establishing a first electric field on the rear wall side of the guide, said first grid having a plurality of apertures therethrough;

a guide grid structure between the first guide grid and the screen for establishing a second electric field, stronger than said first field, on the screen side of the guide while maintaining symmetrical electron beam confining fields within the guide between the first guide grid and the guide grid structure; said guide grid structure including, a second guide grid between the first guide grid and the front wall substantially parallel to the first guide grid, said second guide grid having a plurality of apertures extending therethrough, a third guide grid between the second guide grid and the front wall substantially parallel to the second guide grid, the third guide grid being maintained at the same potential as the second guide grid and having a plurality of apertures therethrough; and means for applying the same potential to the first guide and the grid structure.

2. The device as in claim 1 wherein the apertures in the three grids are aligned.

3. The device as in claim 1 wherein the apertures in the second grid are offset from the apertures in the first grid and the apertures in the third grid are aligned with the apertures in the second grid.

4. The device as in claim 1 wherein the apertures in the second grid are offset from apertures in the first grid and the apertures in the third grid are offset from the apertures in the second grid.

5. The device as in claim 1 wherein the apertures in the first, second and third grids are equal in size.

6. The device as in claim 1 wherein the apertures in the first and second grids are equal in size and the apertures in the third grid are larger than the apertures in the second grid.

7. The device as in claim 1, wherein the guide grid structure comprises a second guide grid substantially thicker than the first guide grid and positioned between the first guide grid and the front wall, said second guide grid having a plurality of apertures therethrough offset from the apertures in the first grid.

8. In a flat panel image display device having an envelope with spaced front and rear walls, a cathodoluminescent screen on the front wall, an electron beam guide within the envelope and means for extracting the electron beam at various points along the guide, the improvement within the guide comprises:

a first guide grid within the envelope spaced from and parallel to the rear wall for establishing a first electric field on the rear wall side of the guide, said first grid having a plurality of apertures therethrough; and a second guide grid substantially thicker than the first guide grid and positioned between the first guide grid and the front wall for establishing a second electric field, stronger than the first field, on the screen side of the guide while maintaining symmetrical electron beam confining fields within the guide between the first guide grid and the second guide grid, said second guide grid having a plurality of apertures therethrough aligned with the aperture in the first guide grid; and means for applying the same potential to the first and second guide grid.

* * * * *